US005133677A

United States Patent [19]

Sato et al.

[11] Patent Number: 5,133,677

[45] Date of Patent: Jul. 28, 1992

[54] ELECTRICAL CONNECTOR AND METHOD OF CONNECTING SHIELDED CABLE TO SAME

[75] Inventors: Kensaku Sato; Naohisa Nakata, both of Tokyo, Japan

[73] Assignee: Hirose Electric Co., Ltd., Tokyo, Japan

[21] Appl. No.: 698,100

[22] Filed: May 10, 1991

[30] Foreign Application Priority Data

Jun. 22, 1990 [JP] Japan ..... 2-162571

[51] Int. Cl.[5] ..... H01R 13/00

[52] U.S. Cl. ..... 439/585

[58] Field of Search ..... 439/394, 578–585

[56] References Cited

U.S. PATENT DOCUMENTS

| | | | |
|---|---|---|---|
| 3,539,976 | 11/1970 | Reynolds | 439/585 |
| 3,648,224 | 3/1972 | McDonough | 439/585 |
| 3,660,805 | 5/1972 | McDonough | 439/585 |
| 3,670,293 | 6/1972 | Garver | 439/585 |

*Primary Examiner*—Joseph H. McGlynn
*Attorney, Agent, or Firm*—Kanesaka & Takeuchi

[57] ABSTRACT

A shield jacket (3) for an electrical connector (B) includes a cylindrical contact support portion (6) having an insulation block (4) for supporting a conductor contact (5); a U-shaped shield wire crimping (7); a U-shaped outer sheath crimping portion (8); a substantially flat linkage portion (6*a*) provided between the contact support portion and the shield wire crimping portion.

A method of connecting a shielded cable to the above electrical connector, which includes the steps of bending downwardly the shield wire and outer sheath crimping portions at the linkage portion; inserting into the insulation block a conductor contact to which a shielded cable has been connected; bending back the shield wire and outer sheath crimping portions to original positions so that the shield wires and outer sheath are placed in the shield wire and outer sheath crimping portions, respectively; and deforming the shield wire and outer sheath crimping portions to the shield wires and the outer sheath, respectively.

3 Claims, 5 Drawing Sheets

ELECTRICAL CONNECTOR AND METHOD OF CONNECTING SHIELDED CABLE TO SAME

BACKGROUND OF THE INVENTION

1. Field of the Invention

The present invention relates to electrical connectors and methods of connecting shielded cables to the electrical connectors.

2. Description of the Prior Art

FIG. 13 shows a conventional electrical connector. A length of outer sheath g is removed from a shielded cable a so that shield wires b and a signal line c are separated. The shield wires b are put together into a shield braid and connected to the contact terminal e of a connector proper d. The signal line c is connected by insulation replacement, for example, to the contact terminal f of the connector proper d.

However, in the above conventional electrical connector, it is necessary to connect separately the shield wires b and the signal line c to the contact terminals e and f, respectively, making it difficult to mechanize the connection operation. In addition, since some shield wires c are removed from the shielded cable, there is little or no shield effect on the signal line.

SUMMARY OF THE INVENTION

Accordingly, it is an object of the invention to provide an electrical connector which makes it easy to connect a shielded cable to a contact terminal and has excellent shield effect.

It is another object of the invention to provide a simple method of connecting a shielded cable to a contact terminal.

According to one aspect of the invention there is provided a shield jacket for an electrical connector, which includes a cylindrical contact support portion having an insulation block for supporting a conductor contact; a U-shaped shield wire crimping portion; a U-shaped outer sheath crimping portion; a substantially flat linkage portion provided between the contact support portion and the shield wire crimping portion.

According to another aspect of the invention there is provided a method of connecting a shielded cable to the above electrical connector, which includes the steps of bending downwardly the shield wire and outer sheath crimping portions at the linkage portion; inserting into the insulation block a conductor contact to which a shielded cable has been connected; bending back the shield wire and outer sheath crimping portions to original positions so that the shield wires and outer sheath are placed in the shield wire and outer sheath crimping portions, respectively; and deforming the shield wire and outer sheath crimping portions to the shield wires and the outer sheath, respectively.

The above and other objects, features, and advantages of the invention will be more apparent from the following description when taken in conjunction with the accompanying drawings.

BRIEF DESCRIPTION OF THE DRAWINGS

FIG. 12 is a perspective view of an electrical contact terminal to which the shielded cable has been connected.

DESCRIPTION OF THE PREFERRED EMBODIMENT

Figure 1:
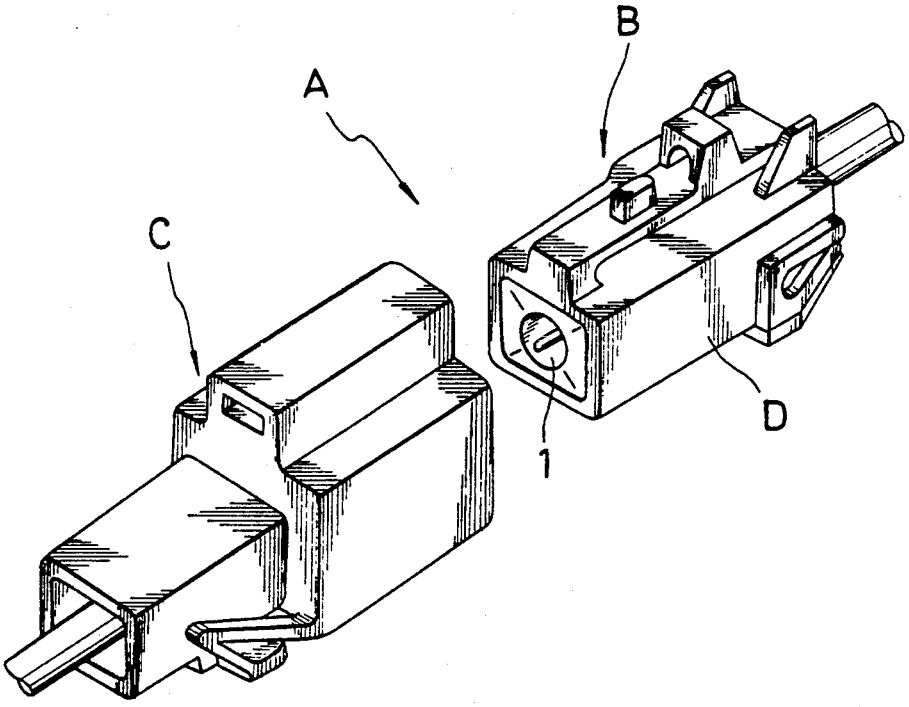
FIG. 1 is a perspective view of electrical connectors before connection.

In FIG. 1, an electrical connector A consists of a female connector B and a male connector C. The female connector B consists of a housing D and an electrical contact terminal 1 therein.

Figure 2:
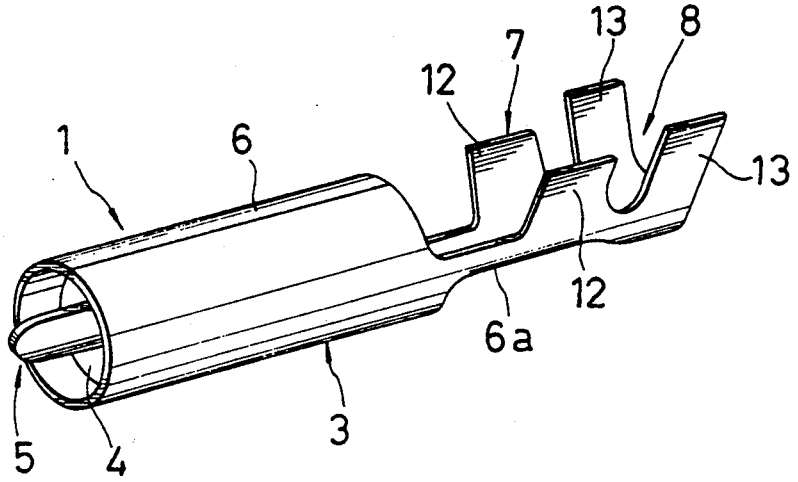
FIG. 2 is a perspective view of a shield jacket for an electrical contact terminal.

In FIG. 2, the electrical contact terminal 1 consists of a shield jacket 3, an insulator block 4, and a conductor (signal line) contact 5.

The shield jacket 3 has a cylindrical contact support portion 6, a U-shaped shield wire crimping portion 7, and a U-shaped outer sheath crimping portion 8. The shield wire crimping portion 7 and the outer sheath crimping portion 8 have a pair of clamp tabs 12 and a pair of clamp tabs 13, respectively.

Figure 3:
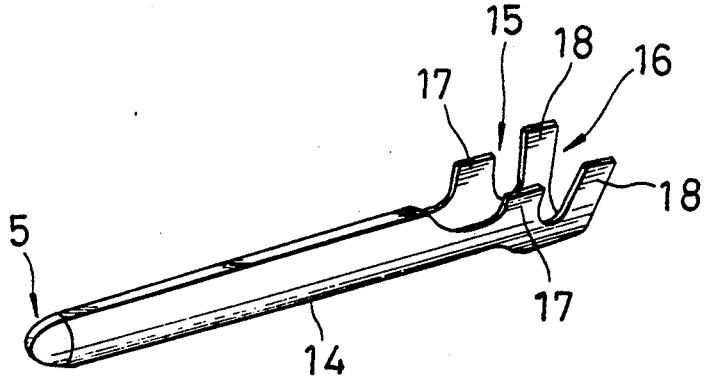
FIG. 3 is a perspective view of a conductor contact for the electrical contact terminal.

In FIG. 3, the conductor contact 5 has a contact proper 14, a U-shaped conductor crimping portion 15 for connection with an insulated conductor, and a U-shaped conductor insulation crimping portion 16. The contact proper 14 has a pin-like form. The conductor crimping portion 15 has a pair of crimping tabs 17. The conductor insulation crimping portion 16 has a pair of crimping tabs 18.

Figure 4:
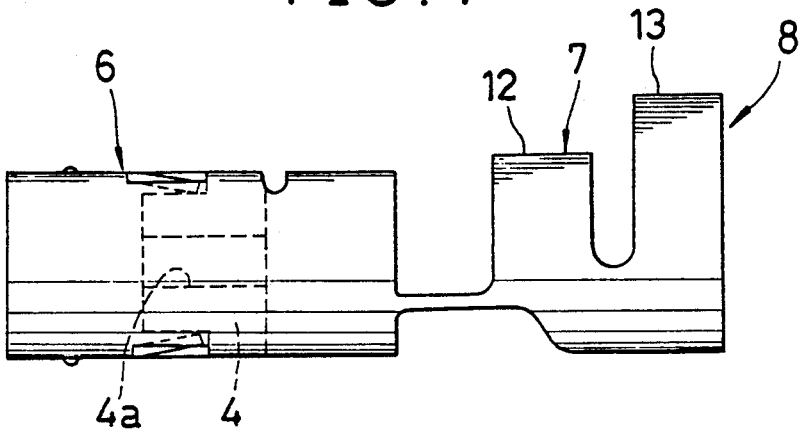
FIG. 4 is a side elevational view of the shield jacket of FIG. 2.
Figure 5:
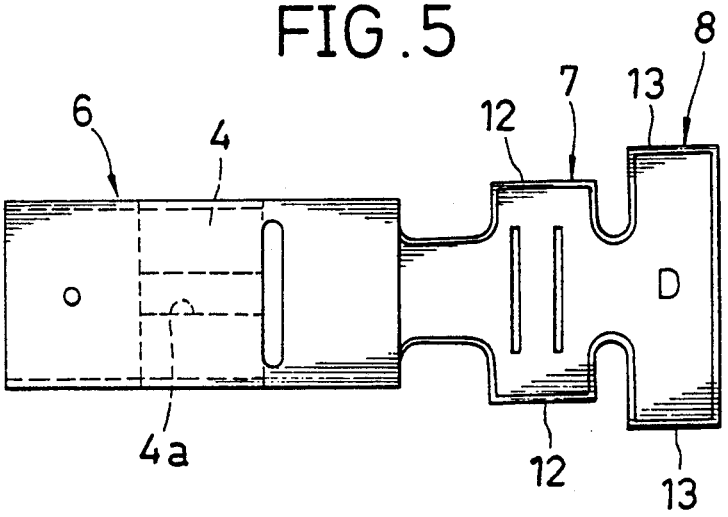
FIG. 5 is a top plan view of the shield jacket of FIG. 2.

In FIGS. 4 and 5, the insulation block 4 is placed within the contact supporting portion 6 of the shield jacket 3 and has a contact supporting aperture 4a through the center of the insulation block 4.

Figure 6:
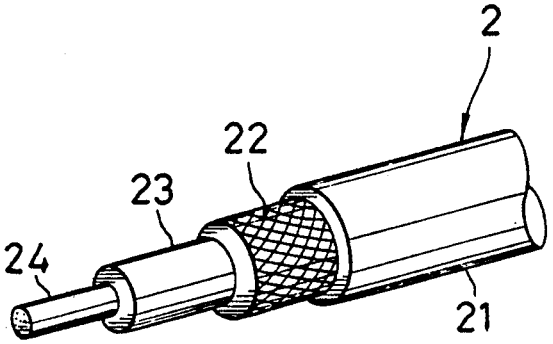
FIG. 6 is a perspective view of a shielded cable.

In FIG. 6, the shielded cable 2 has an outer sheath 21, shield wires 22, a conductor insulation 23, and a conductor wire 24.

How to connect the shielded cable 2 to the electrical contact terminal 1 will be described with reference to FIGS. 7 through 11.

The shielded cable 2 is secured to the conductor contact 5 by inserting and crimping the conductor wire 24 and the conductor insulation 23 of the shielded cable 2 to the conductor crimping portion 15 and the insulation crimping portion 16 of a conductor contact 5, respectively.

Figure 7:
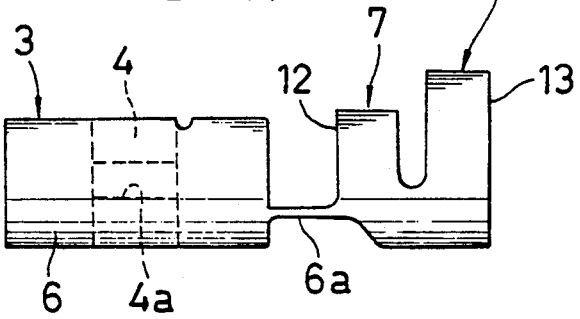
FIG. 7 is a side elevational view of the shield jacket prior to bending.
Figure 8:
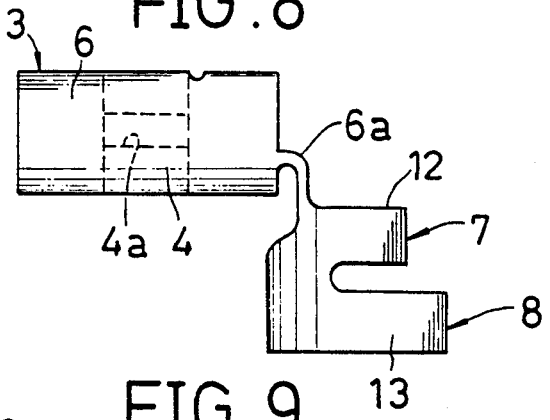
FIG. 8 is a side elevational view of the shield jacket with the shielded cable and outer sheath crimping portions bent downwardly.

In FIGS. 7 and 8, the shielded cable crimping portion 7 and outer sheath crimping portion 8 are bent at a plate-like linkage portion 6a provided between the contact support portion 6 and the shield wire crimping portion 7 by substantially right angles with respect to the contact support portion 6.

Figure 9:
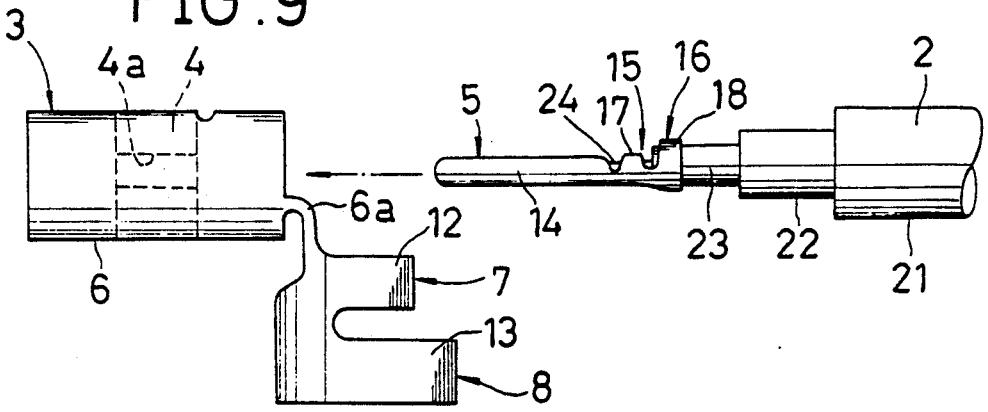
FIG. 9 is a side elevational view of the shield jacket having an insulation block into which the conductor contact of a shielded cable is being inserted.

In FIG. 9, the contact proper 14 of the conductor contact 5 is inserted into the contact support aperture 4*a* of an insulation block 4.

Figure 10:
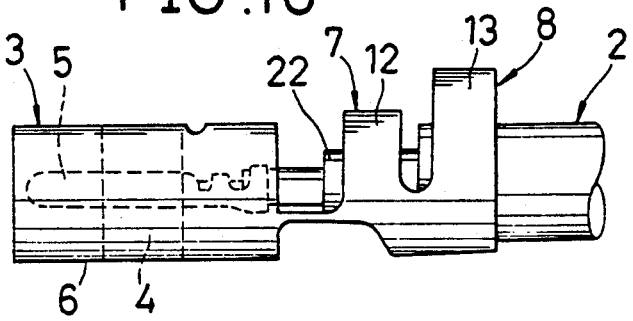
FIG. 10 is a side elevational view of the shield jacket with the shielded cable and outer sheath crimping portions bent back to the original positions.

In FIG. 10, the shield wire crimping portion 7 and sheath crimping portion 8 are bent back to the original position at the linkage portion 6*a* so that the shield wires 22 and outer sheath 21 are placed between the respective crimping tabs 12 and 13 of the shield wire crimping portion 7 and the outer sheath crimping portion 8.

Figure 11:
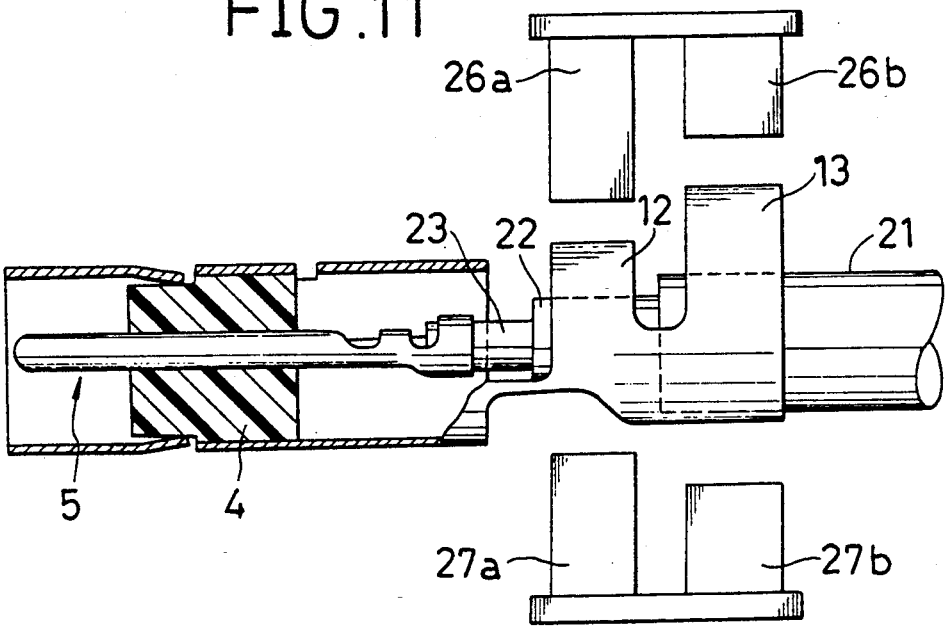
Figure 12:
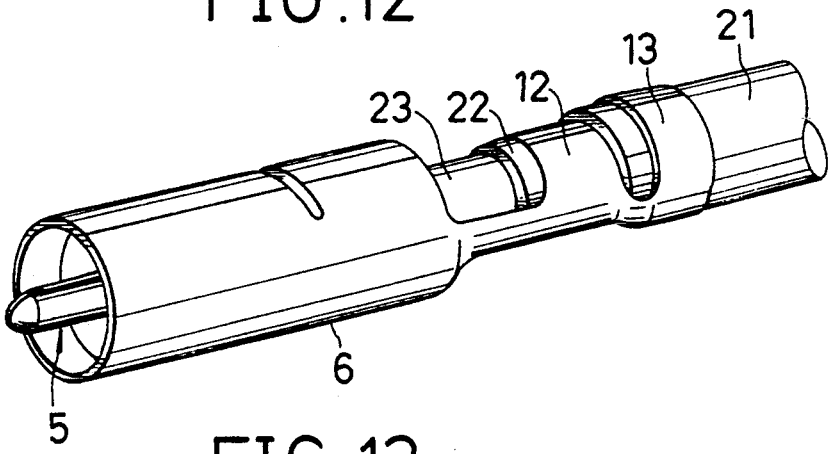
FIG. 12 is a side elevation partly in section of the shield jacket to which a shielded cable is being crimped.
Figure 13:
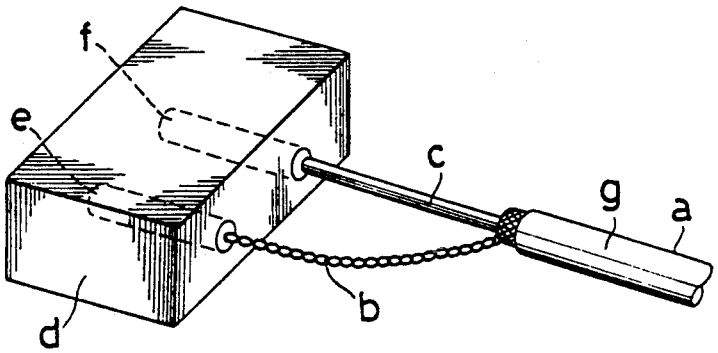
FIG.13 (PRIOR ART)
FIG. 13 is a perspective view of a conventional electrical connector to which a shielded cable is connected.

In FIG. 11, the crimping tabs 12 and 13 of the shield wire crimping portion 7 and the outer sheath crimping portion 8 are simultaneously crimped to the shield wires 22 and the outer sheath 21 with the crimper dies 26*a* and 26*b* and anvils 27*a* and 27*b*.

Alternatively, the conductor crimping portion 15 may be replaced with an insulation replacement portion. In this case, it is unnecessary to remove a length of conductor insulation 23 so as to expose the conductor wire 24. Two or more conductor contacts 5 may be housed in the shield jacket 3 for a multiconductor cable.

As have been described above, the electrical connector and the connection method according to the invention make it easy to connect a shielded cable 2 to a contact terminal.

In addition, since it is unnecessary to provide a tool opening for connecting the conductor connection portion, it is possible to make the shield jacket 3 without the tool opening, thereby providing excellent shielding effect.

We claim:

1. A shield jacket for an electrical connector, comprising:

a contact support portion in which an insulation block is placed for supporting a conductor contact;

a U-shaped shield wire crimping portion;

a U-shaped outer sheath crimping portion;

a substantially flat linkage portion provided between said contact support portion and said shield wire crimping portion to extend in a plane which is substantially perpendicular to clamp tabs of said U-shaped crimping portions so that it is easy to bend downwardly said shield jacket at said linkage portion for facilitating insertion of said conductor contact to which a shielded cable has been connected.

2. A method of connecting a shielded cable to an electrical connector of claim 1, which comprises the steps of:

bending downwardly said shield wire and outer sheath crimping portions at said linkage portion;

inserting into said insulation block a conductor contact to which a shielded cable has been connected;

bending back said shield wire and outer sheath crimping portions to original positions so that said shield wires and outer sheath are placed in said shield wire and outer sheath crimping portions, respectively; and deforming said shield wire and outer sheath crimping portions to said shield wires and said outer sheath, respectively.

3. An electrical contact terminal for a shielded cable, comprising:

a conductor contact to which a conductor wire of said shielded cable is connected;

an insulator block having a contact supporting aperture for supporting said conductor contact; and a shield jacket having a contact supporting portion in which said insulator block is placed, a U-shaped shield wire crimping portion, a U-shaped outer sheath crimping portion, and a substantially flat linkage portion provided between said contact support portion and said shield wire crimping portion to extend in a plane substantially perpendicular to clamp tabs of said U-shaped crimping portions so that it is easy to bend said shield jacket at said linkage portion for facilitating insertion of said conductor contact into said contact supporting aperture.

* * * * *